United States Patent [19]

Kikuchi

[11] Patent Number: 4,691,676

[45] Date of Patent: Sep. 8, 1987

[54] APPARATUS FOR THROTTLE VALVE CONTROL

[75] Inventor: Kazuhiro Kikuchi, Yokohama, Japan

[73] Assignee: Nissan Motor Company, Limited, Kanagawa, Japan

[21] Appl. No.: 837,845

[22] Filed: Mar. 10, 1986

[30] Foreign Application Priority Data

Mar. 12, 1985 [JP] Japan ..... 60-48792

[51] Int. Cl.[4] ..... F02D 41/10; F02D 41/12

[52] U.S. Cl. ..... 123/399; 123/361

[58] Field of Search ..... 123/361, 399, 403

[56] References Cited

U.S. PATENT DOCUMENTS 4,453,516 6/1984 Filsinger ..... 123/399

FOREIGN PATENT DOCUMENTS 2751125 5/1959 Fed. Rep. of Germany .

2607369 8/1977 Fed. Rep. of Germany .

58-131 4/1984 Japan ..... 123/399

99045 6/1984 Japan ..... 123/399

8436 1/1985 Japan ..... 123/399

*Primary Examiner*—William A. Cuchlinski, Jr.

*Attorney, Agent, or Firm*—Schwartz, Jeffery, Schwaab, Mack, Blumenthal & Evans

[57] ABSTRACT

An apparatus responsive to a change in the position of an accelerator pedal for controlling movement of a throttle valve situated within an engine induction passage. The apparatus includes a control circuit for determining a demand value corresponding to a setting of the position of the throttle valve in response to an electrical signal indicative of the position of the accelerator pedal. The calculated demand value is modified whenever the speed of movement of the throttle valve exceeds an upper limit determined in accordance with transmission gear position.

7 Claims, 24 Drawing Figures

FULL OPEN
0.1s
t
OPENING DEGREE
OPENING SPEED
VIBRATION LEVEL
0
5 Hz
10
20
FREQUENCY Hz
(A)
(B)
(C)

FULL OPEN
0.2s
OPENING DEGREE
OPENING SPEED
VIBRATION LEVEL
0
5
10
20
FREQUENCY Hz
(A)
(B)
(C)

FULL OPEN
0.3s
OPENING DEGREE
OPENING SPEED
VIBRATION LEVEL
0
5
10
20
FREQUENCY Hz
(A)
(B)
(C)

APPARATUS FOR THROTTLE VALVE CONTROL

BACKGROUND OF THE INVENTION

This invention relates to an apparatus for controlling movement of a throttle valve in response to a change in the position of an accelerator and, more particularly, to a throttle valve control apparatus which can limit the speed of movement of the throttle valve below an upper limit determined in accordance with transmission gear position.

In order to meter the amount of air to an internal combustion engine, a variable positionable throttle valve is situated within the induction passage of the engine. Normally, a mechanical link mechanism is provided to couple the throttle valve to an accelerator pedal in a manner to move the throttle valve in response to movement of the accelerator pedal. In order to control the throttle valve in a special fashion in response to movement of the accelerator pedal, it has been proposed to substitute an electrical servo control system for the mechanical link mechanism. Such an electrical servo control system includes a potentiometer which converts the movement of the accelerator pedal into a corresponding electric signal which is electrically processed to drive an actuator which thereby moves the throttle valve to a position corresponding to the new position of the accelerator pedal.

The engine produces an output torque which is adjusted under the control of the throttle valve. The engine output torque is transmitted from a flywheel to a plurality of driving wheels through a wheel driving system. The driving system includes a transmission having a plurality of gears which are selectively engageable between a driven shaft and a drive shaft. The driven shaft is coupled through a clutch device to the flywheel. The drive shaft is coupled to a differential gear which divides the transmitted torque to the driving wheels. The engine output torque is transmitted to the driving system along with engine vibrations having a component produced upon a rapid movement of the throttle valve. If the vibration component has a frequency generally equal to the characteristic frequency of the driving system, the driving device will vibrate greatly, causing the vehicle to pitch.

Accordingly, it is the problem in the art to provide a throttle valve control apparatus which can control the throttle valve without resonance of the driving system with respect to engine vibrations.

SUMMARY OF THE INVENTION

There is provided, in accordance with the present invention, an apparatus for use with an internal combustion engine having an accelerator, a throttle valve situated within an induction passage, and a transmission for controlling movement of the throttle valve in response to a change in the position of the accelerator pedal. The apparatus includes first and second signal sources. The first signal source generates an electrical signal indicative of the position of the accelerator pedal. The second signal source generates an electrical signal indicative of the gear position of the transmission. A control circuit determines a demand value corresponding to a setting of the position of the throttle valve in response to the accelerator pedal position indicative signal. A throttle valve actuator is connected to the control circuit for moving the throttle valve to the determined setting. The control circuit includes means for determining an upper limit in accordance with the gear position of the transmission. The control circuit also includes means for modifying the demand value to limit the speed of movement of the throttle valve below the upper limit.

Therefore, the present invention provides a throttle valve control apparatus which can avoid vehicle pitching upon a sudden depression of the accelerator pedal.

BRIEF DESCRIPTION OF THE DRAWINGS

This invention will be described in greater detail by reference to the following description taken in connection with the accompanying drawings, in which like reference numerals refer to the same or corresponding parts, and wherein.

DETAILED DESCRIPTION OF THE PREFERRED EMBODIMENT

Prior to the description of the preferred embodiment of the present invention, the principles of the present invention will be described in order to provide a basis for a better understanding of the present invention.

Figure 1:
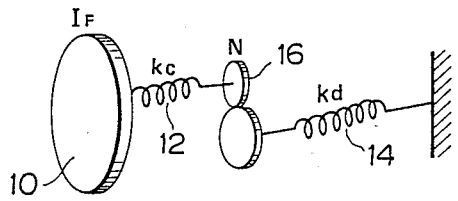
FIG. 1 is a schematic view used in explaining the characteristic frequency of a driving system.

FIG. 1 is a schematic diagram showing a wheel driving system connected to transmit an engine output torque from a flywheel 10 to driving wheels. The driving system includes a transmission 16 having gears which are selectively engageable between a driven shaft and a drive shaft 14. The driven shaft is coupled through a clutch device 12 to the flywheel 10. The characteristic frequency f of the driving system is represented as:

$$f = \frac{1}{2\pi}\sqrt{\frac{Kc + Kd/N^2}{I_F}} \qquad (1)$$

where Kc is the spring constant of the clutch device, Kd is the spring constant of the drive shaft, N is the gear ratio of the transmission, and $I_F$ is the moment of inertia of the flywheel. As can be seen from Equation (1), the characteristic frequency of the driving system is greatly dependent on the gear ratio of the transmission. For front-engine, front-drive automotive vehicles, the characteristic frequency f is about 5 Hz when the transmission is in second forward speed gear and about 7 Hz when the transmission is in third forward speed gear.

Figures 2, 3, 4:
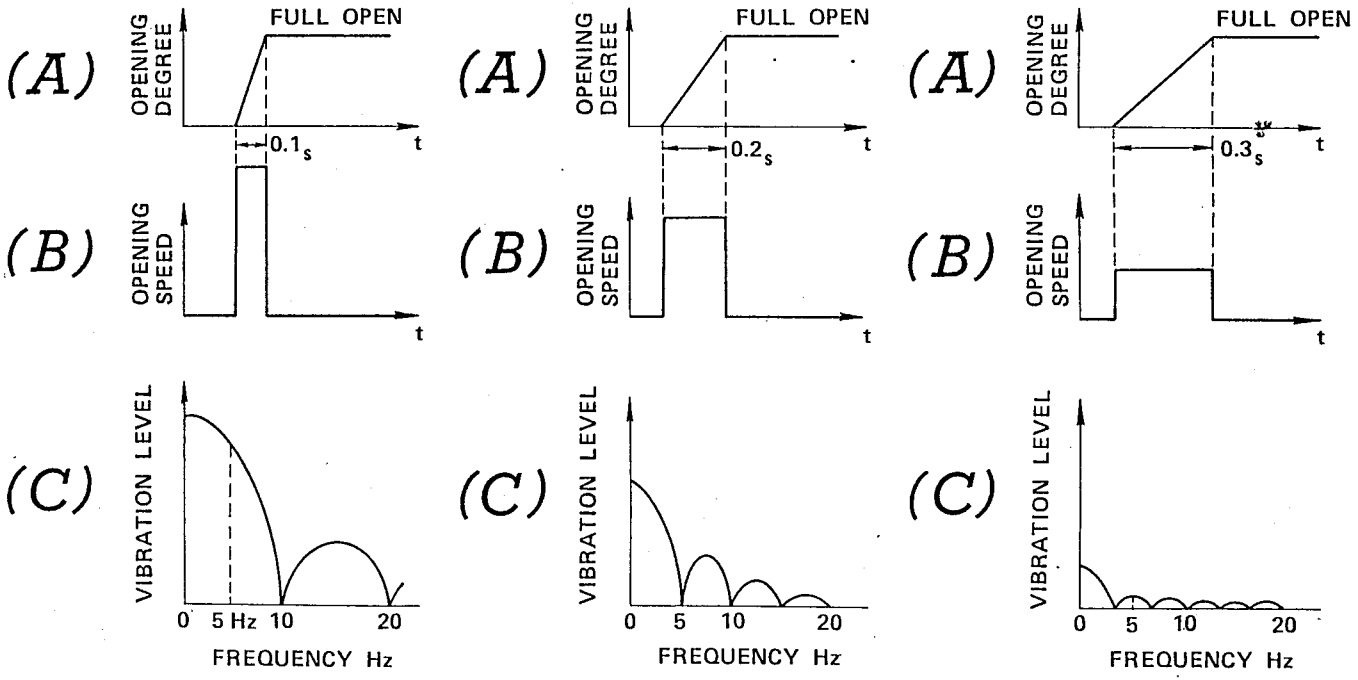
FIGS. 2 to 4 are diagrams used in explaining the principles of the present invention.

The engine vibration component produced upon a rapid movement of the throttle valve has a frequency which is dependent on the speed of movement of the throttle valve or the time duration during which the throttle valve moves from its closed position to its fully open position. FIGS. 2 to 4 show three frequency spectra of the engine vibration component for different speeds of movement of the throttle valve. When the throttle valve moves at a high speed from its closed position to its fully open position in a time of 0.1 seconds, as shown in FIGS. 2(A) and 2(B), the engine vibration component level is high at 5 Hz, as shown in FIG. 2(C). When the throttle valve moves at a medium speed from its closed position to its fully open position in a time of 0.2 seconds, as shown in FIGS. 3(A) and 3(B), the engine vibration component level is at minimum at 5 Hz, as shown in FIG. 3(C). When the throttle valve moves at a low speed from its closed position to its fully open position in a time of 0.3 seconds, as shown in FIGS.4(A) and and 4(B), the engine vibration component level is small substantially over the entire frequency range, as shown in FIG. 4(C).

Assuming now that the transmission is in second forward speed gear, that is, the driving system has a characteristic frequency of about 5 Hz, the driving system will vibrate to such a great extent as to cause vehicle pitching if the time duration during which the throttle valve moves from its closed position to its fully open position is 0.1 seconds or less, as shown in FIG. 2(C). The vehicle pitching problem does not occur when the time duration is 0.2 seconds, as shown in FIG. 3(C), and when the time duration is greater than 0.3 seconds, as shown in FIG. 4(C).

Therefore, the present invention is intended to control the speed of movement of the throttle valve in a manner to avoid resonance of the driving system with respect to engine vibrations.

Figure 5:
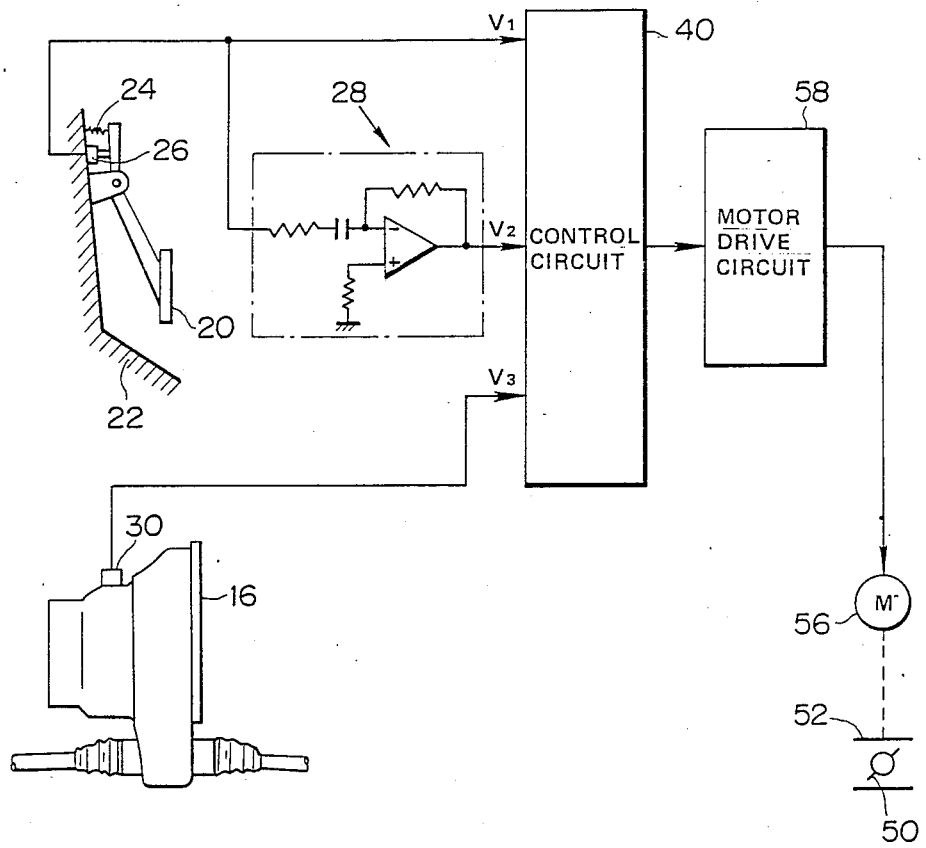
FIG. 5 is a schematic diagram showing one embodiment of a throttle valve control apparatus made in accordance with the present invention.

Referring to FIG. 5, there is shown a schematic block diagram of an automobile throttle valve control system embodying the present invention. In FIG. 5, the reference numeral 20 designates an accelerator pedal which is pivoted on an automobile floor panel 22. A return spring 24 is placed between the accelerator pedal 20 and the floor panel 22 to urge the accelerator pedal 20 to its fully released position. An accelerator pedal position sensor 26, mounted on the floor panel 22, generates an analog signal V1 corresponding to the amount of depression of the accelerator pedal 20. The accelerator pedal position sensor 26 includes a potentiometer connected between a voltage source and electrical ground. The resistance of the potentiometer is a function of the extent to which the accelerator pedal 20 is depressed. The wiper arm of the potentiometer is operatively connected to the accelerator pedal 20 to change the resistance value of the potentiometer as the accelerator pedal moves between its fully released and depressed positions. The analog signal V1 is applied to a control circuit 40 and also to a differentiating circuit 28. The differentiating circuit 28 differentiates the analog signal V1 and generates an analog signal V2 representative of the rate of change of the accelerator pedal position. The analog signal V2 is applied to the control circuit 40. The control circuit 40 also receives a digital signal V3 from a gear position sensor 30 which determines as to which one of the first, second and third forward speed gears is selected in the transmission 16. The gear position sensor 30 may include switches operable to sense the position of the transmission lever along the transmission shift and select directions.

A variable positionable throttle valve 50, mounted as for rotation with a throttle shaft, is situated within an induction passage 52 and effective for controlling the flow of air to the engine. A bi-directional control motor 56 has a motor shaft which is drivingly coupled to the throttle shaft, as indicated by the broken line. The throttle shaft is urged by a return spring (not shown) in a direction closing the throttle valve 50. The control motor 56 functions to vary the position of the throttle valve 50 in a manner as described later. The control motor 56 is electrically controlled and it determines the setting of the throttle valve 50 which, in turn, determines the amount of air admitted to the engine.

The control circuit 40 determines the required new setting, at a given time, of the throttle valve position. The actual setting of the throttle valve is accomplished with the control motor 56 and its drive circuit 58. The control circuit 40 produces a control signal to the drive circuit 58 for controlling the direction and degree of motion of the bi-directional motor 56. Preferably, the control circuit 40 calculates a demand valve $\theta o$ for the position of the throttle valve 50 from selected one of different relationships. These relationships define throttle valve position demand value $\theta o$ as a function of accelerator pedal position signal V1 in different modes. In this case, the control circuit 40 is arranged to select one of the different relationships in accordance with the signal V2 fed from the differentiating circuit 28. The control circuit 40 modifies the calculated demand value $\theta o$ in accordance with the signal V3 fed from the transmission gear position sensor 30.

The control circuit 40 may employ a digital computer which shall be regarded as including an analog-to-digital converter, a central processing unit, a memory, a timer, and a digital-to-analog converter. The analog-to-digital converter receives the analog signal V1 from the accelerator pedal position sensor 26 and also an analog signal V2 from the differentiating circuit 28 and converts the received signals into corresponding digital signals for application to the central processing unit. The memory contains the program for operating the central processing unit and further contains appropriate data in look-up tables used in calculating appropriate values for the position of the throttle valve 50. The look-up data may be obtained experimentally or derived empirically. The central processing unit may be programmed in a known manner to interpolate between the data at different entry points if desired. Control words specifying a desired throttle valve position are periodically transferred by the central processing unit to the digital-to-analog converter. The digital-to-analog converter converts the transferred information into analog form and applies a control signal to the drive circuit 58 for controlling the direction and degree of motion of the control motor 56.

Figure 6A:
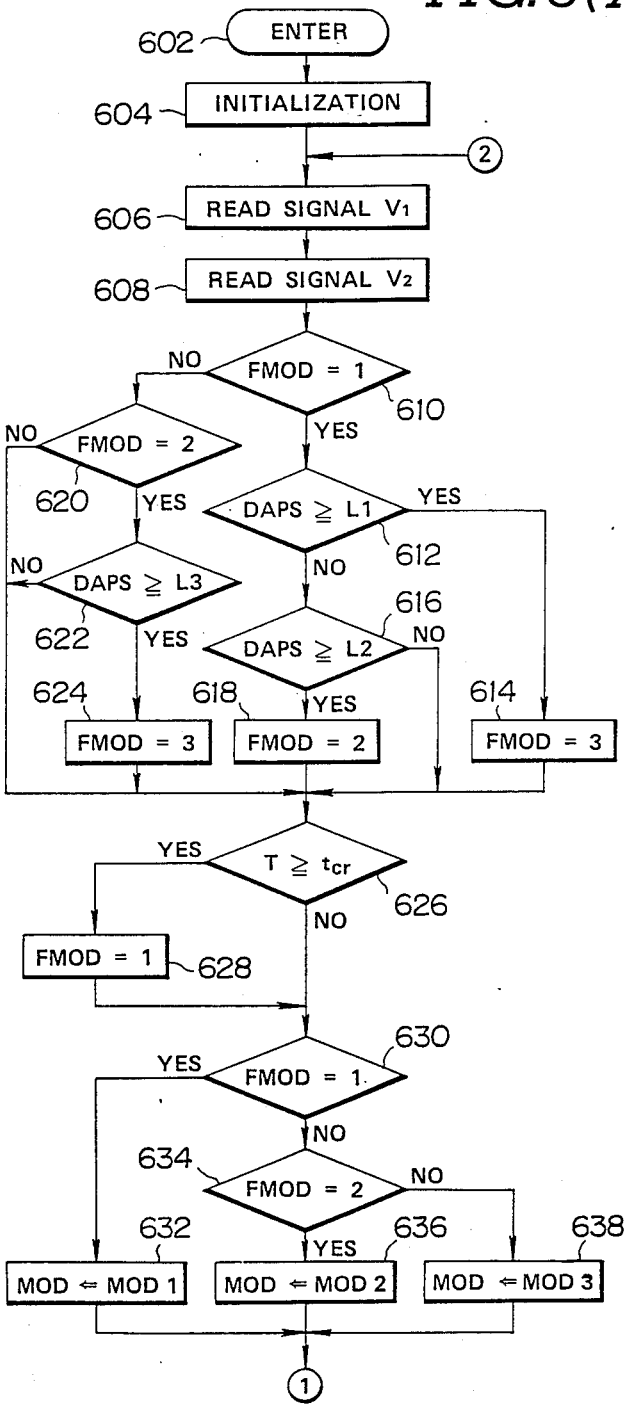
FIGS. 6(A) and 6(B) are flow diagrams of the programming of the digital computer used in the control circuit of FIG. 5 for calculating demand values for throttle valve position.
Figure 7:
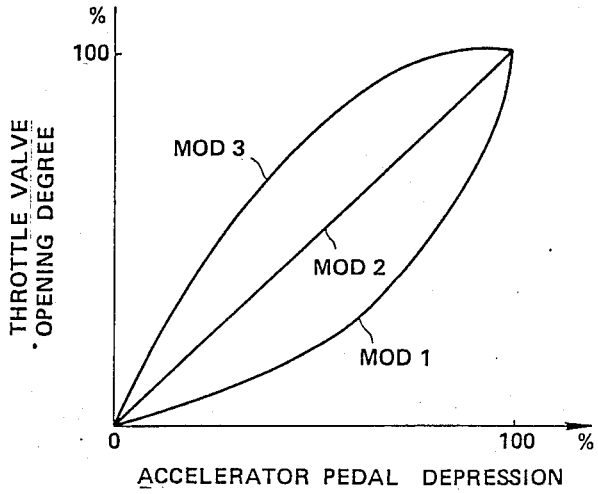
FIG. 7 is a graph showing different relationships used in calculating throttle valve position demand values.

FIG. 6A is a flow diagram of the programming of the digital computer used in the control circuit 40 for selecting one of relationships from which the central processing unit calculates a demand value $\theta o$ for the position of the throttle valve 50. These relationships are shown in FIG. 7 and they defines throttle valve position demand value $\theta o$ as a function of accelerator pedal position signal V1 in different modes. The first mode (MOD 1) relates to a control mode in which an accelerator pedal position change causes a smaller throttle valve position change in the region where the amount of depression of the accelerator pedal is small. This control mode is desirable, for example, in driving a vehicle under a traffic snarl condition. The second mode (MOD 2) relates to a normal control mode in which the throttle valve position changes in direct proportion to an accelerator pedal position change. The third mode (MOD 3) relates to a control mode in which an accelerator pedal position change causes a greater throttle valve position change in the region where the amount of depression of the accelerator pedal is small. This control mode is effective to provide higher acceleration performance.

The computer program is entered at the point 602. At the point 604 in the program, the central processing unit makes an initialization. This operation includes setting a mode flag FMOD at 1 which indicates a demand for calculation of the throttle valve position demand value $\theta o$ from the relationship indicated as the first mode (MOD 1) in FIG. 7. Following this, the analog signals V1 and V2 are, one by one, converted by the analog-to-digital converter into digital form. Thus, at the point 606 in the program, the accelerator pedal position signal V1 is converted to digital form and read into the computer memory. At the point 608, the accelerator pedal position change rate signal V2 is converted to digital form and read into the computer memory.

At point 610 in program, a determination is made as to whether or not the mode flag FMOD is at 1. If the answer to this question is "yes", then the program proceeds to another determination point 612. This determination is as to whether or not the read value DAPS for accelerator pedal position change rate is equal to or greaer than a predetermined value L1. If the answer to this question is "yes", then the program proceeds to the point 614 where the mode flag (FMOD) is set at 3 which indicates a demand for calculation of the throttle valve position demand value $\theta o$ from the relationship indicated as the third mode (MOD 3) in FIG. 7. Following this, the program proceeds to the point 626. That is, the control mode is changed from the first mode (MOD 1) to the third mode (MOD 3) when the read value DAPS is equal to or greater than the predetermined value L1. This is effective to provide higher acceleration performance when the accelerator pedal is depressed at a high speed. Otherwise, the program proceeds to the point 616.

At the point 616 in the program, a determination is made as to whether or not the read value DAPS for accelerator pedal position change rate is equal to or greater than a predetermined value L2 which is smaller than the predetermined value L1. If the answer to this question is "yes", then it means that the read value DAPS is in the range from the value L2 to the value L1 and the program proceeds to the point 618 where the mode flag (FMOD) is set at 2 which indicates a demand for calculation of the throttle valve position demand value $\theta o$ from the relationship indicated as the second mode (MOD 2) in FIG. 7. Following this, the program proceeds to the point 626. That is, the control mode is changed from the first mode (MOD 1) to the second mode (MOD 2) so as to return the control mode to a normal mode. Otherwise, the program proceeds to the point 626. This means that the control mode is held in the first mode when the read value DAPS is smaller than the predetermined value L2.

If the answer to the question inputted at the point 610 is "no", then the program proceeds to a determination point 620. This determination is as to whether or not the mode flag (FMOD) is at 2. If the answer to this question is "no", then it means that the mode flag (FMOD) is at 3 and the program proceeds to the point 626. That is, the control mode is held in the third mode (MOD 3) regardless of the read value DAPS for accelerator pedal position change rate. Otherwise, the program proceeds to another determination point 622. This determination is as to whether or not the read value DAPS for accelerator pedal position change rate is equal to or greater than a predetermined value L3 which is smaller than the predetermined value L1 and greater than the predetermined value L2. If the answer to this question is "yes", then it means that the read value DAPS is in the range from the value L3 to the value L1 and the program proceeds to the point 624 where the mode flag (FMOD) is set at 3 and then the program proceeds to the point 626. That is, the control mode is changed from the second mode (MOD 2) to the third mode (MOD 3) to provide higher acceleration performance when the read value DAPS for accelerator pedal position change rate is equal to or greater than the predetermined value L3. Otherwise, the program proceeds directly to the point 626. This means that the control mode is held in the second mode (MOD 2) when the read value DAPS for accelerator pedal position change rate is less than the predetermined value L3.

At the point 626 in the program, a determination is made as to whether or not the time duration durint T which the accelerator pedal is held at the fully depressed position is greater than a predetermined value $\tau cr$, for example, 1 seconds. If the answer to this question is "yes", then the program proceeds to the point 628 where the mode flag (FMOD) is set at 1 and then the program proceeds to the point 630. Otherwise, the program proceeds directly to the point 630. The accelerator pedal 20 is released whenever the transmission gear position is changed such as for vehicle acceleration. However, such transmission gear position change is normally made within 1 seconds. Thus, the mode is normally not changed to the first mode (MOD 1) at the point 628.

At the point 630 in the program, a determination is made as to whether or not the mode flag (FMOD) is at 1. If the answer to this question is "yes", then the program proceeds to the point 632 where the central processing unit selects the relationship of the first mode (MOD 1) for calculating an throttle valve position demand value $\theta o$ therefrom. Otherwise, the program proceeds to another determination point 634. This determination is as to whether or not the mode flag (FMOD) is at 2. If the answer to this question is "yes", then the program proceeds to the point 636 where the central processing unit selects the relationship of the second mode (MOD 2) for calculation of the demand value $\theta o$ therefrom. Otherwise, it means that the mode flag (FMOD) is at 3 and the program proceeds to the point 638 where the central processing unit selects the relationship of the third mode (MOD 3) for calculation of the demand value $\theta o$ therefrom.

Figure 6B:
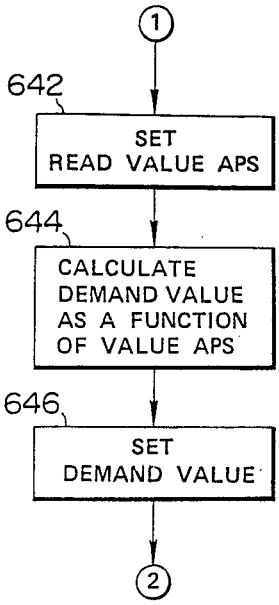

FIG. 6B is a flow diagram of the programming of the digital computer used in the control circuit 40 for calculating a deman value $\theta o$ for the position of the throttle valve 50. After one relationship is selected for calculating throttle valve position demand values $\theta o$, the program proceeds to the point 642 in which the read value APS for accelerator pedal position is set in the computer memory. At the point 644 in the program, the central processing unit calculates a demand value $\theta o$ for the position of the throttle valve 50 from the relationship which defines throttle valve position demand value θo as a function of accelerator pedal position read value APS. This relationship has a mode selected in the flow diagram of FIG. 6A. At the point 646, the calculated demand value θo is set in the computer memory. Following this, the program returns to the point 606 of the flow diagram of FIG. 6A.

Figure 8:
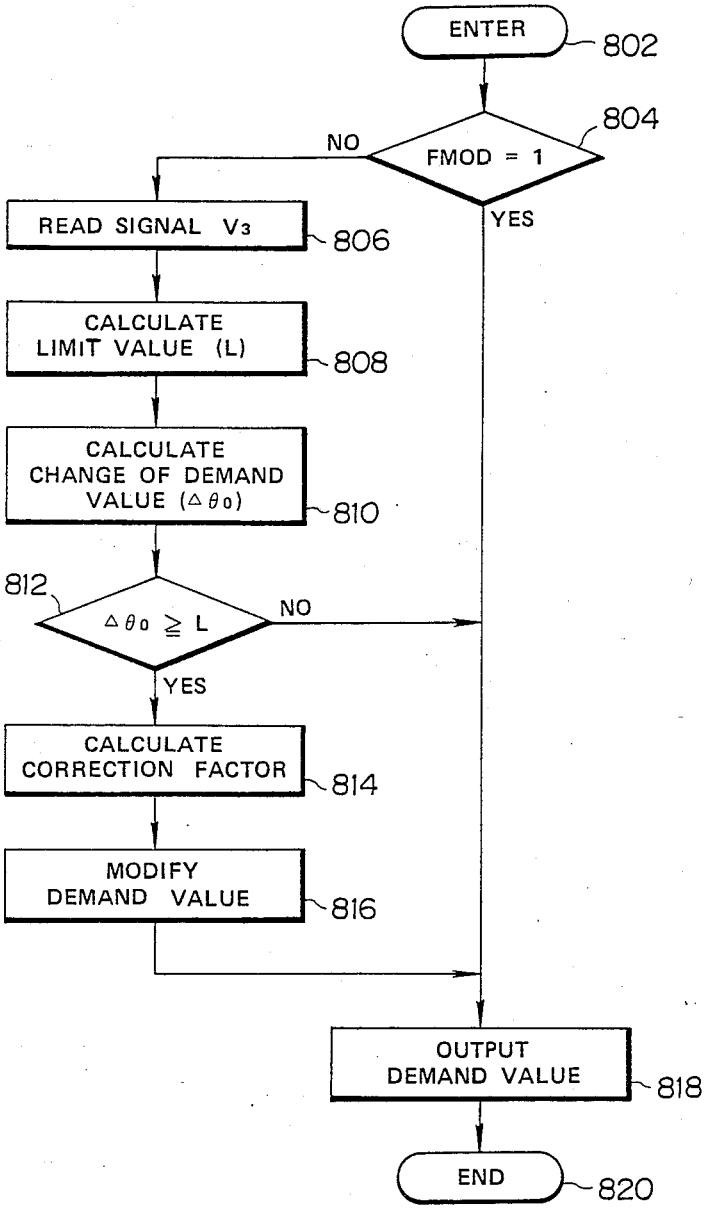
FIG. 8 is a flow diagram of the programming of the digital computer used in the control circuit for modifying the calculated throttle valve position demand values.

FIG. 8 is a flow diagram of the programming of the digital computer used in the control circuit 40 for modifying the calculated throttle valve position demand value. The computer program is entered at the point 802 each time the central processing unit sets the calculated throttle valve position demand value θo into the computer program at the point 646 of the flow diagram of FIG. 6B. At the point 804 in the program, a determination is made as to whether or not the mode flag (FMOD) is at 1. If the answer to this question is "yes", then the program proceeds directly to the point 818 where the calculated demand value θo is transferred with no modification to the digital-to-analog converter. The reason for this is that vehicle pitching would not occur at any transmission gear position if the throttle valve position is controlled from the relationship of the first mode (MOD 1). If the throttle valve position demand value θo is calculated from the relationship of the second or third modes, vehicle pitching would occur in the presence of a sudden engine output increase which causes engine vibrations having a frequency substantially equal to the characteristic frequency of the driving system. For this reason, the calculated throttle valve position demand value θo set at the point 646 of the flow diagram of FIG. 6B is modified at the points 806 to 816 in a manner to avoid vehicle pitching.

If the answer to the question inputted at the point 804 is "no", then the program proceeds to the point 806 where the signal V3, which indicates the position of the transmission gear, is read into the computer memory. At the following position 808, a limit value is calculated from a relationship programmed into the computer. The relationship defines limit value as a function of transmission gear position. The limit value corresponds to an upper limit for the demanded speed of movement of the throttle valvve. The upper limit corresponds to the time duration during which the throttle valve opens from its closed position to its fully open position. For example, the upper limit may be set in such a manner that the time duration is 0.2 seconds when the transmission is in second forward speed gear, 0.14 seconds when the transmission is in third forward speed gear, and 0.125 seconds when the transmission is in fourth forward speed gear. The limit value may be determined from these upper limits for the respective transmission gear positions and modified in connection with the time required for each cycle of execution of the program. The demand value may be outputted without any modification when the transmission is in fourth forward speed gear where the engine vibration component is at a low level and at increased frequencies.

Figure 9:
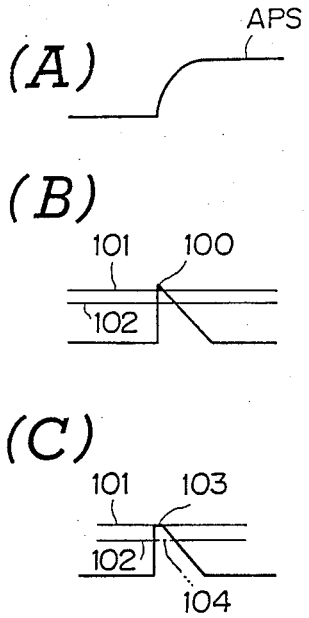
FIGS. 9(A–C), 10(A–C) and 11(A–C) are diagrams used in explaining the manner to modify the calculated throttle valve position demand values.
Figure 10:
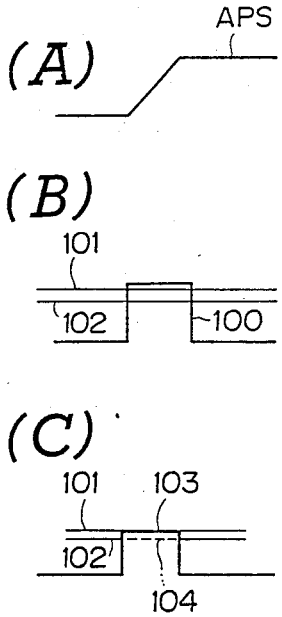
Figure 11:
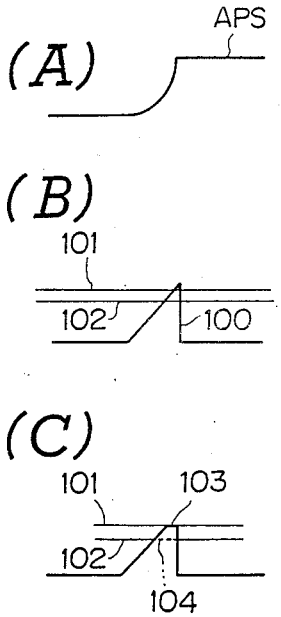

At the point 810 in the program, the central processing unit determines a change of the throttle valve position for the time required in each cycle of execution of the program. This determination is made by calculating a difference between new and last demand values for the position of the throttle valve. The calculated difference corresponds to the demanded speed of movement of the throttle valve. At the point 812 in the program, a determination is made as to whether or not the throttle valve position change is equal to or greater than the calculated limit value. If the answer to this question is "no", then the program proceeds to the point 818. That is, the calculated throttle valve position demand value θo is outputted, with no modification, to the digital-to-analog converter. Otherwise, the program proceeds to the point 814 where the central processing unit determines a correct factor. This determination is made by calculating a difference of the throttle valve position change from the limit value. Following this, at the point 816, the central processing unit modifies the throttle valve position demand value θo by subtracting the correct factor from the throttle valve position demand value θo. This modification is effective to limit the speed of movement of the throttle valve below the upper limit when the calculated throttle valve position change rate exceeds the upper limit, as shown in FIGS. 9 to 11. FIGS. 9(A), 10(A) and 11(A) show three different modes of change of the accelerator pedal position (APS). In FIGS. 9(B), 10(B) and 11(B), the reference numeral 100 indicates variations in the rates of change of the throttle valve position demand value calculated in the respective modes of change of the accelertor pedal position shown in FIGS. 9(A), 10(A) and 11(A). The reference numeral 101 designates an upper limit calculated when the transmission is in second forward speed gear and the reference numeral 102 designates an upper limit calculated when the transmission is in third forward speed gear. In FIGS. 9(C), 10(C) and 11(C), the reference numeral 103 indicates variations in the rate of change of the throttle valve position demand value resulting from the modification made at the point 816 when the transmission is in the second forward speed gear and the reference numeral 104 indicates variations in the rate of change of the throttle valve position demand value resulting from the modification made at the point 816 when the transmission is in third forward speed gear. Following this, the program proceeds to the point 818 where the modified throttle valve position demand value is transferred to the digital-to-analog converter. The program proceeds from the point 818 to the end point 820.

There has been provided, in accordance with the present invention, a throttle valve control apparatus which limits the speed of movement of the throttle valve below an upper limit determined by the transmission gear position so as to minimize the level of engine vibration component having a frequency substantially equal to the characteristic frequency of a wheel driving system. It is, therefore, possible to avoid vehicle pitching upon a sudden depression of the accelerator pedal.

While this invention has been described in conjunction with a specific embodiment thereof, it is evidence that many alternatives, modifications and variations will be apparent to those skilled in the art. For example, the accelerator pedal may be replaced with an accelerator lever or other accelerators which are used to provide a demand for engine accelerator and deceleration. Accordingly, it is intended to embrace all alternatives, modifications and variations that fall within the scope of the appended claims.

What is claimed is:

1. An apparatus for use with an internal combustion engine having an accelerator, a throttle valve situated within an induction passage, and a transmission, comprising:

a first signal source for generating an electrical signal indicative of the position of said accelerator;

a second signal source for generating an electrical signal indicative of the gear position of said transmission;

a control circuit operable to determine a demand value corresponding to a setting of the position of said throttle valve in response to said accelerator position indicative signal;

a throttle actuator connected to said control circuit for moving said throttle valve to said determined setting; and said control circuit including means for determining an upper limit in accordance with the gear position of said transmission, means for setting said upper limit at a first predetermined value when said transmission is in a lower gear and at a second predetermined value smaller than said first predetermined value when said transmission is in a higher gear, and means for modifying said demand value to limit the speed of movement of said throttle valve below said upper limit.

2. The apparaus as claimed in claim 1, wherein said control circuit includes means for storing new and old demand values calculated successively, and means for calculating a speed value for the speed of movement of said throttle valve based upon a difference between said new and old demand values.

3. The apparatus as claimed in claim 2, wherein said control circuit includes means for modifying said demand value based upon a difference between said speed value and said upper limit.

4. An apparatus for use with an internal combustion engine having an accelerator, a throttle valve situated within an induction passage, and a transmission, comprising:

a first signal source for generating an electrical signal indicative of the position of said accelerator;

a second signal source for generating an electrical signal indicative of the gear position of said transmission;

a control circuit operable to determine a demand value corresponding to a setting of the position of said throttle valve in response to said accelerator position signal;

a throttle actuator connected to said control circuit for moving said throttle valve to said determined setting; and said control circuit including means for determining an upper limit in accordance with the gear position of said transmission, means for setting said upper limit at a first predetermined value when said transmission is in second forward gear and at a second predetermined value smaller than said first predetermined value when said transmission is in third forward speed gear, and means for modifying said demand value to limit the speed of movement of said throttle valve below said upper limit.

5. The apparatus as claimed in claim 4, wherein said control circuit includes means for storing new and old demand values calculated successively, and means for calculating a speed value for the speed of movement of said throttle valve based upon a difference between said new and old demand values.

6. The apparatus as claimed in claim 5, wherein said control circuit includes means for modifying said demand value based upon a difference between said speed value and said upper limit.

7. The apparatus as claimed in claim 6, wherein said control circuit includes means for inhibiting modification of said demand value when said transmission is in first forward speed gear.

* * * * *